US005345626A

United States Patent [19]

Newton

[11] Patent Number: 5,345,626

[45] Date of Patent: Sep. 13, 1994

[54] FUTON FRAME

[75] Inventor: John H. Newton, West Hartford, Vt.

[73] Assignee: Nordic Engineering, Inc., West Hartford, Vt.

[21] Appl. No.: 54,897

[22] Filed: Apr. 28, 1993

[51] Int. Cl.[5] ..... A47C 17/17

[52] U.S. Cl. ..... 5/37.1; 5/41; 5/42.1

[58] Field of Search ..... 5/18.1, 37.1, 38, 41, 5/42.1

[56] References Cited

U.S. PATENT DOCUMENTS

| | | | |
|---|---|---|---|
| 4,104,747 | 8/1978 | Bell et al. | 5/37.1 |
| 4,696,069 | 9/1987 | Crosthwaite | 5/42.1 X |
| 5,195,194 | 2/1993 | Bradley et al. | 5/42.1 X |

*Primary Examiner*—Michael F. Trettel
*Attorney, Agent, or Firm*—Michael J. Weins

[57] ABSTRACT

An improved frame for a futon sofa/chair having a first base end and a second base end. The base ends have guide slots which engage guide posts, the guide posts are mounted to a back, which is pivotably attached to a seat. The improvement resides in providing backstops attached to the first base end and the second base end which further support the back of the sofa/chair when the back is upright and when the back is horizontal. In another embodiment of the invention, the frame additionally has a rear deck panel which is pivotably attached to the back and a pair of rear deck supports which are pivotably mounted to the rear deck panel and to the base ends. In a further preferred embodiment, the rear deck supports have deck segment supports which pivotably attach to the rear deck panels and base segment supports, which pivotably attach to the base. The rear deck supports and the rear base segment supports are in turn pivotably connected.

25 Claims, 9 Drawing Sheets

FUTON FRAME

FIELD OF INVENTION

The present invention relates to a frame for a futon which, when opened, provides a platform for supporting an extended futon for a bed and, when closed, supports a folded futon which serves as a sofa/chair. More particularly, the present invention relates to improvements which increase the stability of the frame in both the open and closed position.

BACKGROUND OF THE INVENTION

There are a variety of futon frames currently available that serve the dual function of providing a frame for a sofa and a bed. Many of these frames employ guide posts mounted on the back of the sofa which ride in guide slots in the base of the sofa. The guide posts, directed by the slots, assist in directing the back from an upright position to a horizontal position.

U.S. Pat. No. 3,107,364 is an early patent which employs a slot in combination with springs to facilitate the raising and lowering of a back element of a sofa. The frame, in addition to employing springs, requires additional hardware to provide the action required to convert the sofa to a bed.

U.S. Pat. No. 3,634,893 provides a sofa having either a two section bed surface (bi-fold sofa) or a three section bed surface (tri-fold sofa). Both types of frames have horizontal slots which assist in the raising and lowering of the sofa and do not require the use of a spring as part of the mechanism. However, the sofa of the '893 patent, while overcoming the need for springs, still requires extensive hardware to perform the desired function and, in addition, uses sectional cushions attached to the frame to form the bed surface.

U.S. Pat. No. 4,642,823 offers an improvement over the '364 patent and the '893 patent by reducing the hardware required by these earlier cited patents. However, in order to avoid flexing of the back and seat elements when the sofa is opened to form a bed, locking pins are required which can be extended into the back. Furthermore, when the back is in the upright position and the frame serves as a sofa, there is no locking mechanism to assure that the sofa will not inadvertently slip, reverting to a bed, if a substantial load is placed on the back. The only resistance to a load being placed on the back is the friction in the mechanisms, the weight of the back and seat of the frame, and the weight of the futon resting thereon.

U.S. Pat. No. 4,996,730 is similar to the '823 patent, however, does not provide the pins for locking the seat with respect to the back.

U.S. Pat. No. 4,875,244 has overcome the problem of the sofa inadvertently opening to form a bed even if a substantial pressure is applied to the back. The seat lockably engages the base of the sofa. However, this frame does not provide the locking mechanism provided by the '823 patent to assure that the back and seat will not flex when the seat and the back are aligned to form a bed.

The problem of providing a frame which will not inadvertently open or which will not flex when the seat and the back are aligned to form a base for an extended futon has been solved by the inventor of the present application in his earlier patent, U.S. Pat. No. 5,083,333 wherein he teaches the use of pins which are selectively engaged with slots of the sofa, locking the back with respect to the seat.

U.S. Pat. No. 5,153,951 also employs pins which engage slots to stabilize the back relative to the seat. However, the shape and configuration of the slots of the '951 patent would provide for less positive stabilization of the back in the upright position than the shape and configuration of the slots of the '333 patent.

While the mechanisms taught in the '333 patent and the '951 patent lock the seat with respect to the back, additional mechanisms are required if the seat and back are to be stabilized with respect to the frame. Without such stabilization, the back can overshoot to an upright position, resulting in high loads and torques on the frame. Sofas employing the hinge of the '333 patent as well as the sofas of the '244 patent, the '823 patent, and the '730 patent can be stabilized by having the ends of the guide slots positioned to serve as a stop to avoid overshooting of the back. However, if the ends of the slots are not properly aligned, since there is at best line contact, twisting of the seat and back with respect to the frame can occur. The twisting can interfere with the smooth action of the raising and lowering of the back.

Furthermore, there is no teaching in the '823, '244, '730, '333, or the '951 patents which would suggest a tri-fold sofa, let alone one that would couple the movement of a rear deck panel to the movement of the back. When the sofa is a tri-fold, the problem of twisting of the back with respect to the base can create additional problems by off setting the rear deck panel which, when coupled to the base, can result in additional torsional load. These loads can further interfere with raising or lowering the back to convert the sofa to a bed.

Thus, there is a need for a sofa/chair frame that will provide improved stability of the seat and back with respect to the frame and for a tri-fold sofa or chair that can be readily opened from the front in a single operation.

SUMMARY OF THE INVENTION

It is an object of the invention to provide a support member that will enhance the stability of the seat and back member with respect to the frame in both the closed and open positions.

It is another object of the invention to provide a frame which can be readily opened and closed in a single action.

It is a further object of the invention to provide a tri-fold futon frame that provides a chair when closed and a single bed when opened.

It is another object of the invention to provide a tri-fold futon frame that serves as a sofa frame when closed and a king size bed frame when opened.

It is still a further object of the invention to provide a tri-fold frame which can be readily opened in a single action.

These and other objects of the invention will become apparent from the descriptions, drawings, and claims.

The present invention, in its simplest form, provides an improved frame for a sofa/chair having a back which is pivotably connected to a seat. The frame into which the improvement can be incorporated is a frame which has a back that lowers to a horizontal position and becomes parallel to the seat, providing a frame for supporting an extended futon.

The improvement of the present invention is employed with frames having a base which supports a seat having a seat leading edge and a seat back edge. The frames to which the improvements apply also have a back having a back top edge and a back bottom edge. The base has a first base end and a second base end. The back of the frame is fitted with guide posts, and guide slots are provided in the base ends. The guide slots engage the guide posts and, in combination, assist in guiding the back from an upright position to a horizontal position.

One aspect of the improvement of the present invention is to provide for increased stability of the back and the seat of a sofa/chair futon frame. A first backstop which attaches to the first base end of the frame and a second backstop which attaches to the second base end of the frame are provided to increase the stability of the back and seat when mounted in the base of the frame.

The backstops which attach to the base ends extend from the base ends and terminate in backstop free surfaces which are preferably substantially parallel the base ends. The backstops have backstop upper support surfaces which are substantially parallel to the guide slots in the base ends and are positioned below the guide slots such that when the back is lowered to a horizontal position, the back will rest on the upper support surfaces. The backstops have backstop upright support surfaces which engage the back and provide support thereto when the back is in the upright position.

A pair of rear linkages are pivotably mounted to the back and are also either directly or indirectly pivotably mounted to the base ends. These rear linkages assist in guiding the back in a smooth path from an upright position to a horizontal position where the seat and the back are co-planar.

It is still further preferred that the back has back side rails and that the rear linkages are pivotably mounted to the backstop free surfaces and to the back side rails. These back side rails, in combination with a back top edge and a back bottom edge, bound the back. The backstops preferably have a width W which is equal to or greater than the width of the back side rails so that the back side rails can be fully supported by the backstop upper support surfaces and the backstop upright support surfaces.

The rear linkages are preferably positioned such that, when engaged with the back and the backstops, the rear linkages are substantially parallel to the backstop free surfaces.

Preferably, the base has front cross members which connect the base ends and has an upper front cross member edge which is co-planar with the upper support surfaces of the backstops.

In one embodiment of the present invention, the frame is provided with a rear deck panel which pivotably attaches to the back. Such sofa/chairs are herein after referred to as tri-fold sofa/chairs. The tri-fold chair has a rear deck panel which, when co-planar with the seat and back, will form a platform which will support an extended single bed size futon. Similarly, a tri-fold sofa will also provide a platform for supporting an extended king size futon.

For the tri-fold sofa/chair frame, the bed support is formed by the seat, the back, and a rear deck panel which are co-planar. Preferably, the rear deck has a back deck edge which attaches to the back and a free end. The back deck edge of the rear deck panel is mounted such that the rear deck panel pivots with respect to the back to form an "A" frame sofa/chair when the back is in the upright position.

Rear deck supports are pivotably mounted to the rear deck panel and to the base ends. To increase the stability of the rear deck panel when the frame is opened, it is preferred that at least one rear deck panel leg be provided and that it be pivotably mounted to the rear deck panel.

In one preferred embodiment, the rear deck supports have a deck segment support which pivotably attaches to the rear deck panel. The rear deck supports also have base segment supports which pivotably attach to the base. The deck segment support and the base segment support are also pivotably mounted with respect to each other.

When the rear deck supports have two segments it is further preferred that deck stops be provided which limit the rotation of the rear deck panel to assure that the rear deck panel cannot swing past the base segment support of the rear deck support.

It is further preferred that the rear deck panel have rear deck side rails and that when the deck supports have two segments, the base segment supports be positioned between the rails. When so mounted, the free end of the rear deck panel will serve as the deck stop.

To increase the stability of the frame when opened to form a bed frame, it is preferred that the seat be provided with one or more pivotably mounted seat legs that can be lowered when the sofa/chair is positioned for use as a bed.

BEST MODE FOR CARRYING THE INVENTION INTO PRACTICE

Figure 1:
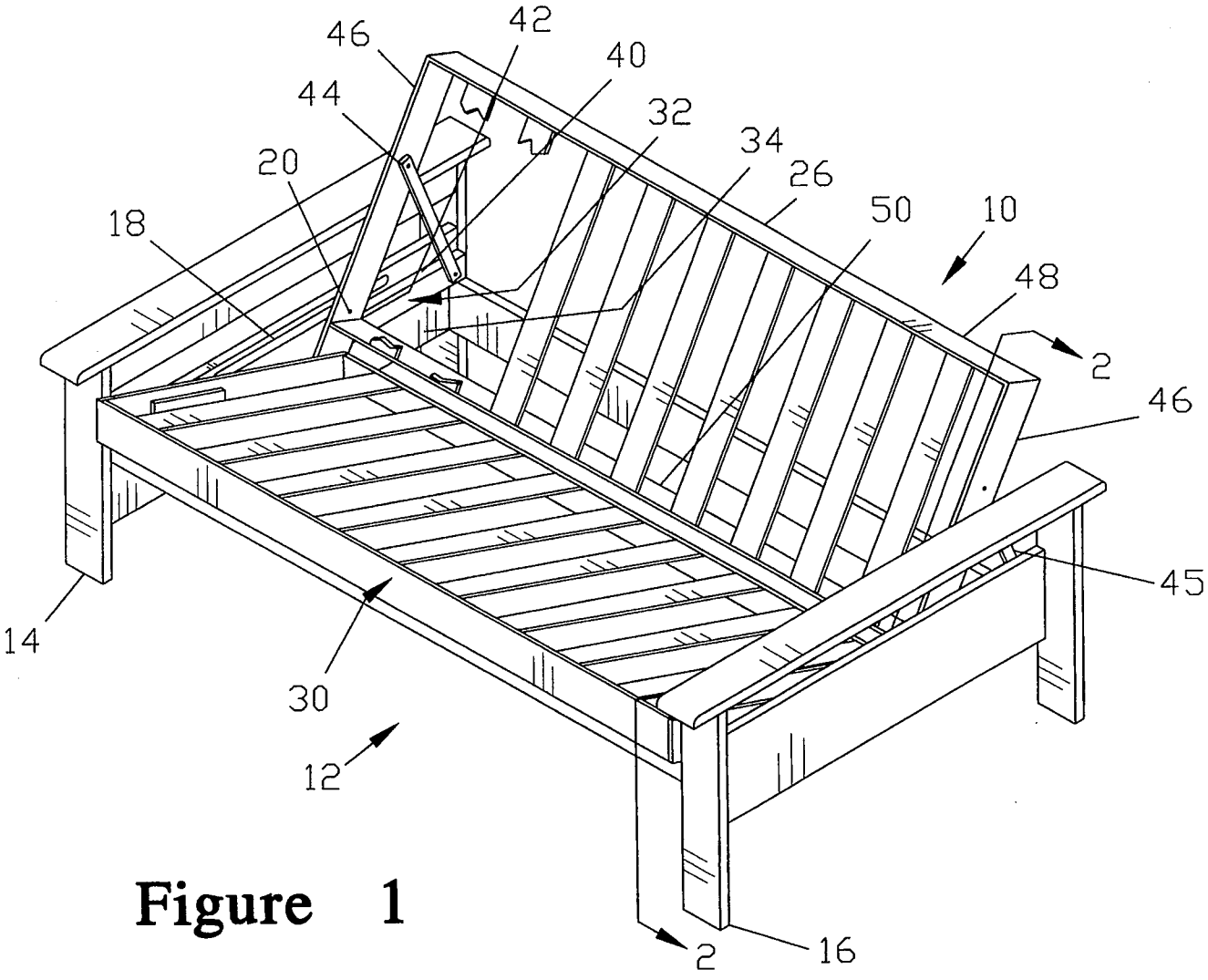
FIG. 1 illustrates one of the improvements of the present invention for a sofa. Part of the back is not shown to more fully display a first backstop.

FIG. 1 shows a sofa frame 10 for a futon. The sofa frame 10 is conventional in many respects, having a base 12 which in turn has a first base end 14 and a second base end 16. The first base end 14 has a first guide slot 18 in which a first guide post 20 rides. Similarly, as shown in FIG. 2, which is an isometric view from the plane of the section 2—2 of FIG. 1, the second base end 16 has a second guide slot 22 in which a second guide post 24 rides.

The first guide post 20 and the second guide post 24 are attached to a back 26 which is, in turn, pivotably attached to a seat 30. A section of the back 26 has been removed in FIG. 1 to better illustrate additional structure of the frame located behind the back 26. The guide posts 20 and 24 and the guide slots 18 and 22 assist in guiding the back 26 as it is raised and lowered.

Figure 2:
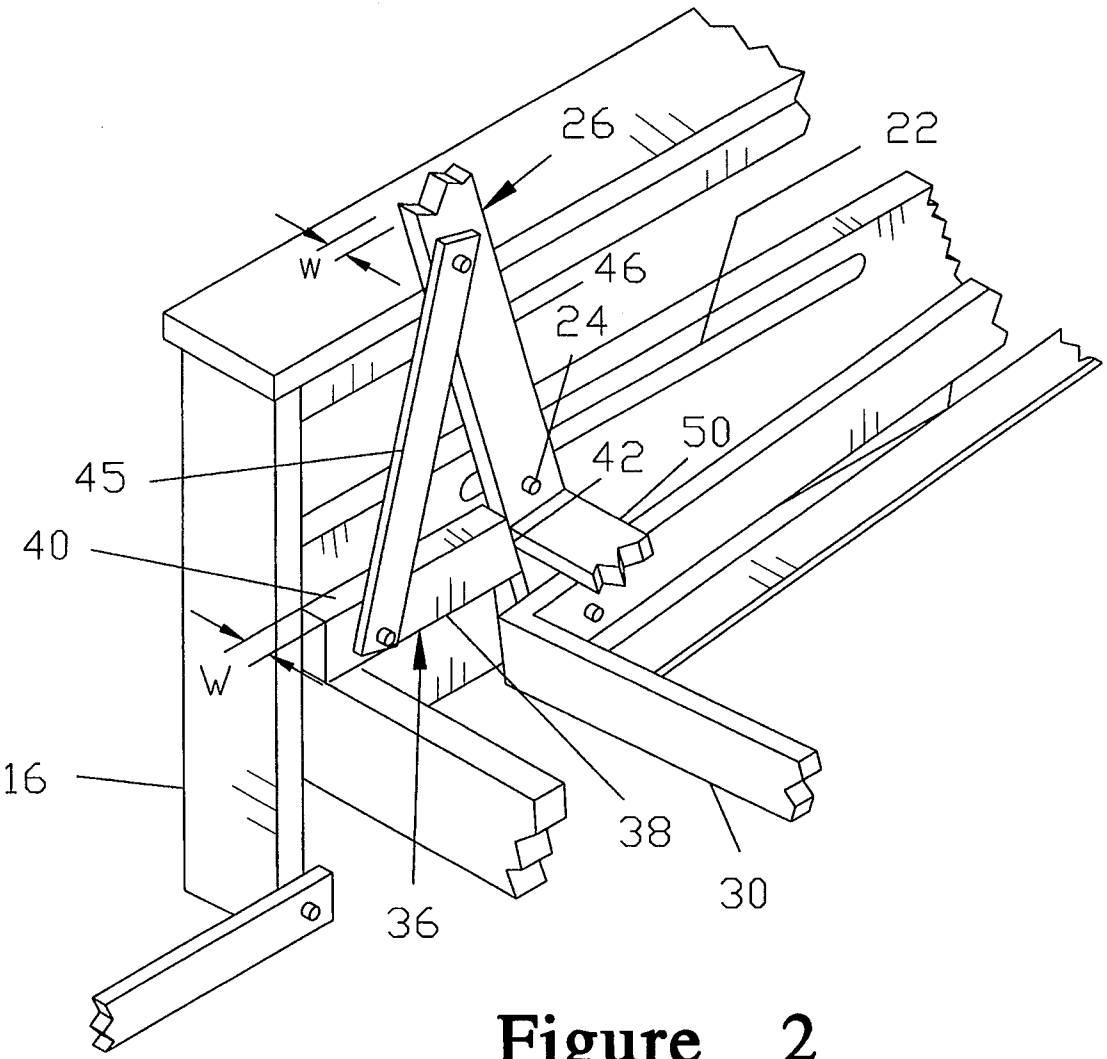
FIG. 2 shows an isometric view from the plane of section 2—2 of FIG. 1 and shows a second backstop for the sofa of FIG. 1.

The improvement of the embodiment shown in FIGS. 1 and 2, in its simplest form, is a pair of backstops. A first backstop 32 is attached to the first base end 14 and extends therefrom, terminating in a first end surface 34. The first end surface 34 is spaced apart and substantially parallel to the first base end 14. Similarly, a second backstop 36 is attached to the second base end 16 and extends therefrom, terminating in a second end surface 38 as shown in FIG. 2. The backstops 32 and 36 have upper support surfaces 40 and upright support surfaces 42.

A first rear linkage 44 is pivotably mounted to the back 26 with respect to the first base end 14, while a second rear linkage 45 is pivotably attached to the back 26 with respect the second base end 16. These rear linkages 44 and 45, in combination with the guide slots 18 and 22 and guide posts 20 and 24, direct the motion of the back 26 from the upright position where the back 26 is braced by the upright support surfaces 42 of the backstops 32 and 36 to a horizontal position where the back 26 is supported by the upper support surfaces 40.

Since the upright support surfaces 42 provide planer contact with the back 26, they stabilize the back 26 and inhibit the rocking of the back 26 when in the upright position. When the back 26 is in the horizontal position, the back 26 is supported by the upper surfaces 40 of the backstops 32 and 36. Again, since the upper surfaces 40 are planer, they assist in stabilizing the back 26 when the back 26 is in a horizontal position.

In the embodiment illustrated in FIGS. 1 and 2, the back 26 is bounded by side rails 46, a back top edge 48, and a back bottom edge 50. The side rails 46 pivotably mount to the seat 30, as is shown in FIG. 2. It is preferred that the width W of the backstops 32 and 36 be equal to or greater than the width w of the side rails 46 so that the side rails 46 are fully supported by the backstops 32 and 36.

Figure 3:
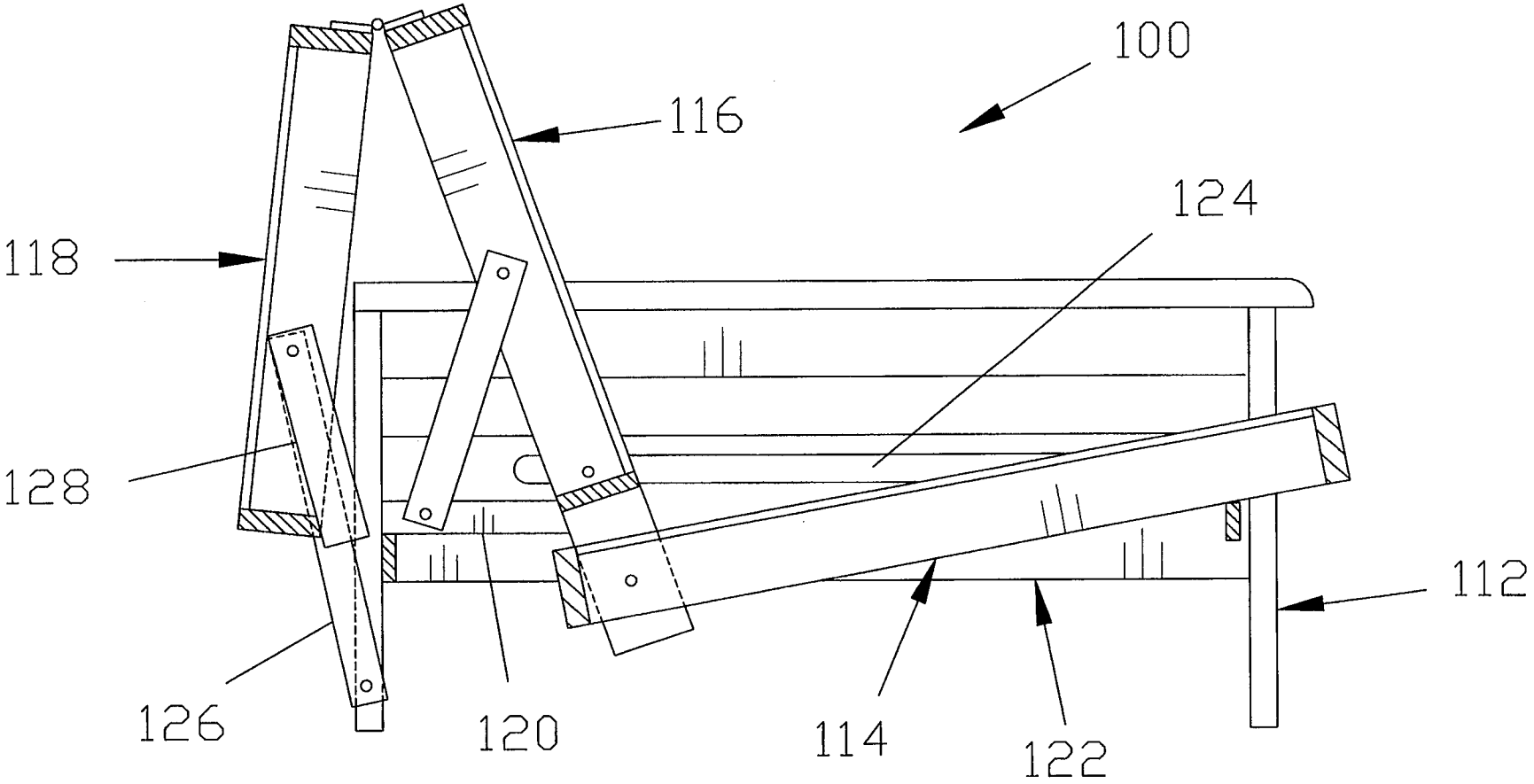
FIG. 3 is a sectional view of an "A" frame sofa incorporating another embodiment of the present invention. The "A" frame includes one piece rear deck supports which coordinate the movement of the rear deck panel with the movement of the back and the seat of the frame.
Figure 4:
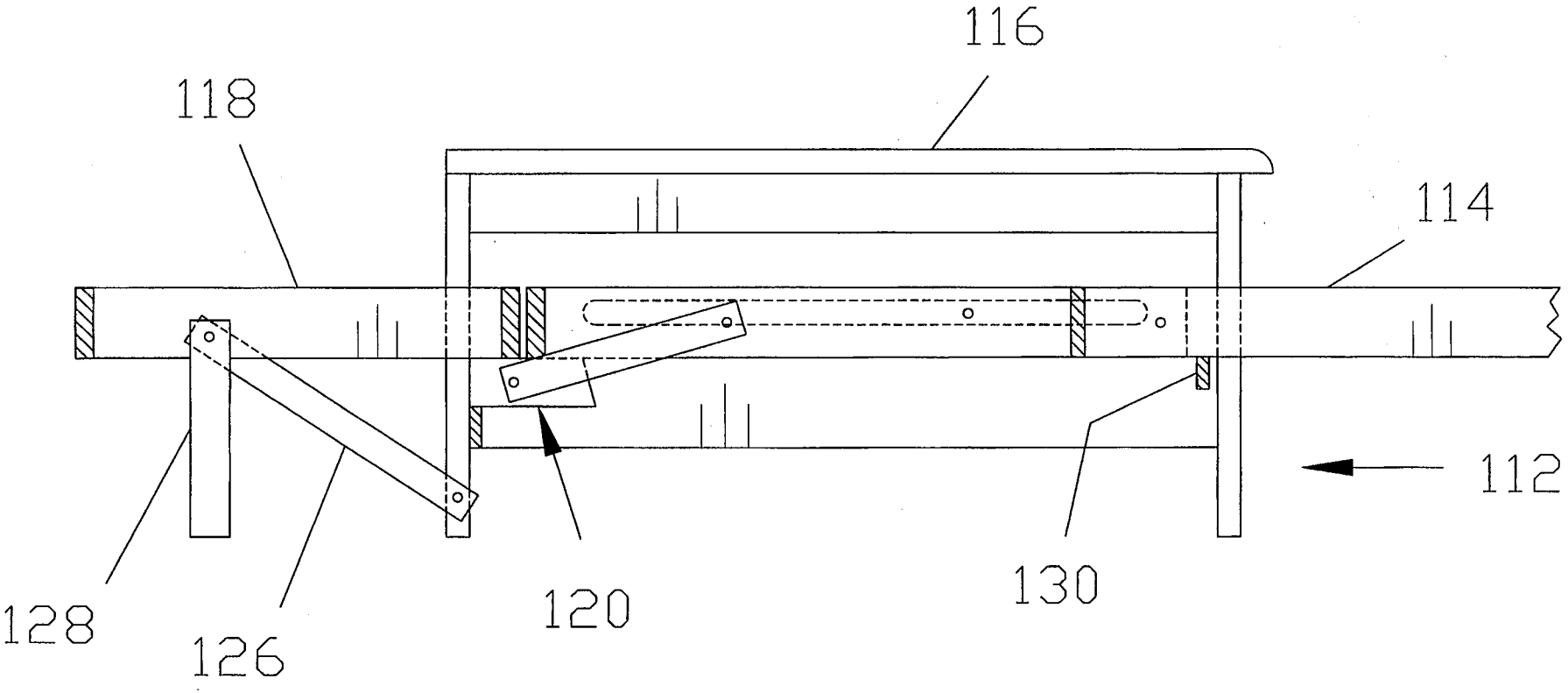
FIG. 4 is the sectional view of FIG. 3, however, in this view, the back has been lowered so that the rear deck panel, the back and the seat form a platform for supporting an extended futon.

FIGS. 3 and 4 illustrate an embodiment of the present invention which is incorporated into a tri-fold sofa. FIG. 3 illustrates a cross section of a frame having a base 112, a seat 114, a back 116, and a rear deck panel 118. Frames which are so configured are frequently referred to as tri-fold frames since the futon support surface has three sections. They are also known as "A" frames since the back 116 and the rear deck panel 118 form an "A" when the frame is in its closed position.

The "A" frame 100 illustrated in FIGS. 3 and 4, employs the backstops 120, discussed earlier, with respect to the sofa, illustrated in FIGS. 1 and 2. The "A" frame 100 also provides rear deck supports 126 which are pivotably attached to the rear deck panel 118 and to the base 112. The rear deck supports 126 coordinate the movement of the rear deck panel 118 with the movement of the back 116, allowing the "A" frame 100 to be opened and closed with a single movement. The rear deck supports 126 also provide support to the rear deck panel 118 when the "A" frame 100 is open as is illustrated in FIG. 4 to form a platform for supporting an extended futon. It is preferred that at least one rear deck panel leg 128 be provided which is pivotably attached to the rear deck panel 118.

Figure 9:
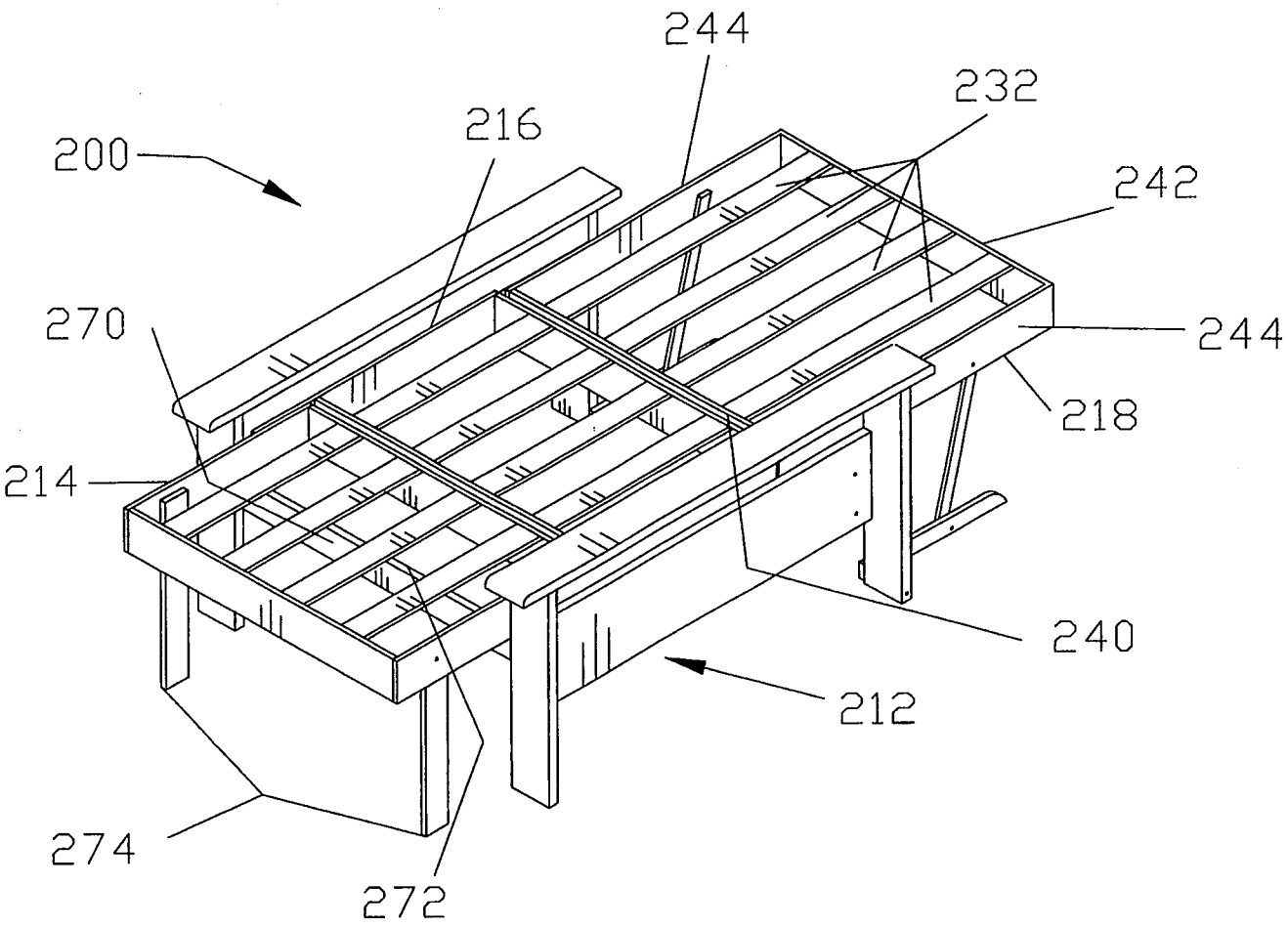
FIG. 9 is an isometric view of the chair frame illustrated in FIGS. 5 through 8 showing the frame in the open position for supporting an extended futon and serving as a bed.

When the "A" frame 100 is opened, support for the seat 114 is provided by a front cross member 130 of the base 112. Additional support for the seat 114 may also be provided by seat legs 274 such as shown in FIG. 9.

While the rear deck support 126, depicted in FIGS. 3 and 4, is of unitary construction, it is possible to provide a rear deck support which is constructed from two pivotably connected segments. FIGS. 5 through 9 depict a frame with two segment rear deck supports.

The discussion of the two segment rear deck support element is illustrated and discussed in terms of the chair embodiment. The distinction between the chair and the sofa is the distance between the ends of the frame. Thus, with respect to the two segment rear deck support, the chair represents all the necessary structure for the inclusion of the two segment rear deck supports. A chair frame 200 such as illustrated in FIGS. 5 through 9, also illustrates other aspects of the invention which can be incorporated into a frame which employs unitary rear deck supports.

The principal difference between a chair frame and a sofa frame resides in the over all dimensions of the bed which can be accommodated. A tri-fold frame readily accommodates a single bed futon in a chair configuration and a king size bed futon in a sofa configuration.

Figure 5:
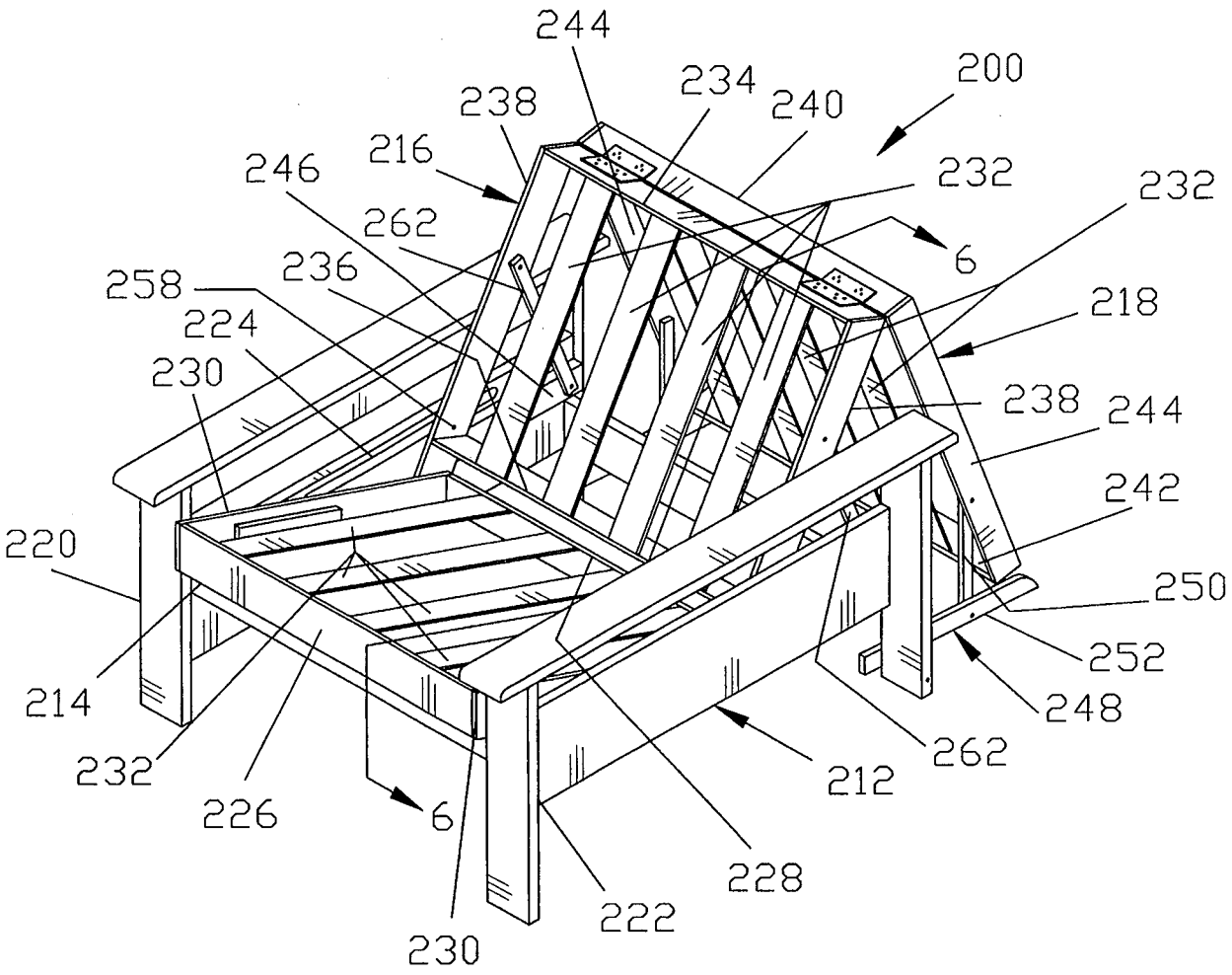
FIG. 5 is an isometric view of an "A" frame chair which includes the backstops and two segment rear deck supports. The distinction between a chair frame and the sofa frame is the distance between the ends.

FIG. 5 is an isometric view of a futon frame 200 demonstrating several aspects of the improvements of the present invention. The frame 200 has a base 212, a seat 214, a back 216, and a rear deck panel 218.

A frame, shown in FIG. 5, is an "A" frame and has a seat 214, a back 216, and a rear deck panel 218 which are pivotably connected. The base 212 has a first base end 220 and a second base end 222. The first base end 220 and the second base end 222 have guide slots 224, shown in FIGS. 5 and 9. The seat 214 has a seat leading edge 226 and a seat back edge 228 which are parallel and spaced apart. The seat 214 is further bounded by seat side rails 230 that attach to the seat leading edge 226 and the seat back edge 228. Slats 232 are provided for additional support of a futon (not shown) placed thereon.

Similarly, the back 216 is bounded by a back top edge 234, a back bottom edge 236, and back side rails 238. The back side rails 238 extend beyond the back bottom edge 236 and pivotably engage the seat side rails 230. Slats 232 are again provided for additional support of a futon placed thereon.

The rear deck panel 218 is bounded by a rear deck panel back edge 240 and a free end 242. Rear deck panel side rails 244 attach to the rear deck panel back edge 240 and the free end 242 to define the rear deck panel 218. Slats 232 are provided for supporting a futon.

Figure 6:
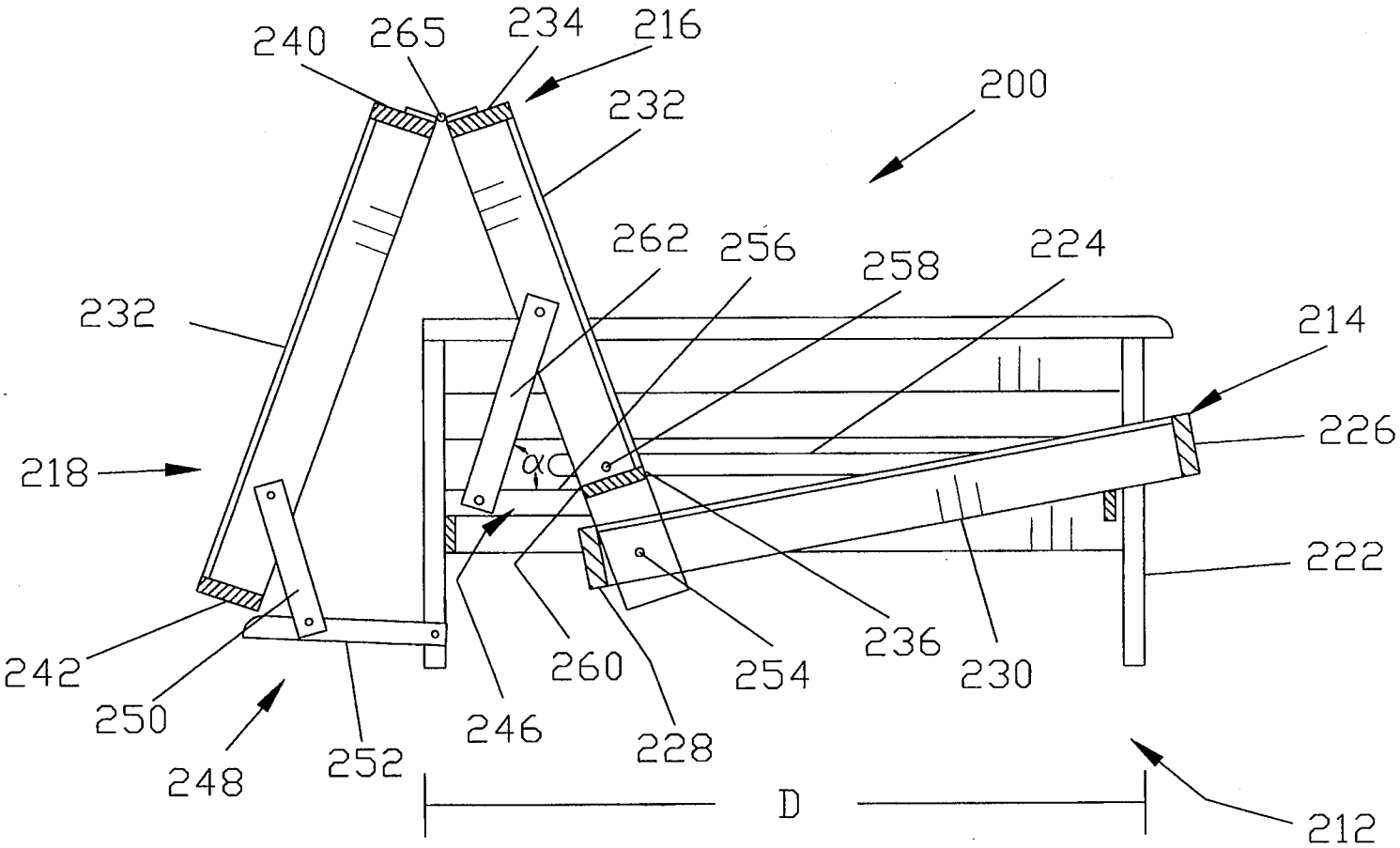
FIG. 6 is a section 6—6 of FIG. 5 showing the frame with the back in the upright position providing a chair frame.

Backstops 246 are attached to the first base end 220 and to the second base end 222. FIG. 6 illustrates one of the backstops 246 and how the backstops 246 are attached to the second base end 222 and its placement with respect to the frame 200.

The rear deck panel 218 of the embodiment illustrated in FIGS. 5 through 9 has rear deck supports 248 which have deck support segments 250 and base support segments 252. Each of the base support segments 252 is pivotably attached to the rear deck panel 218. Similarly, each of the base support elements 252 is pivotably attached to the base 212 and to a deck support segment 250. Being so connected raises the rear deck panel 218 into a horizontal position as the back 216 is lowered to the horizontal position. The rear deck supports 248 being so connected, simplify the opening and closing of the frame 200 and substantially reduce the effort required to raise and lower a futon the size of a king size mattress.

FIG. 6 shows a cross section 6—6 of the futon frame 200 of FIG. 5. The seat 214 is pivotally attached to the back 216 with pins 254. If a hinging mechanism is sought that will provide positive locking of the seat back 216 with respect to the seat 214, hinges of patents such as the '333 patent of the present inventor or the '951 patent will provide such locking.

Figure 7:
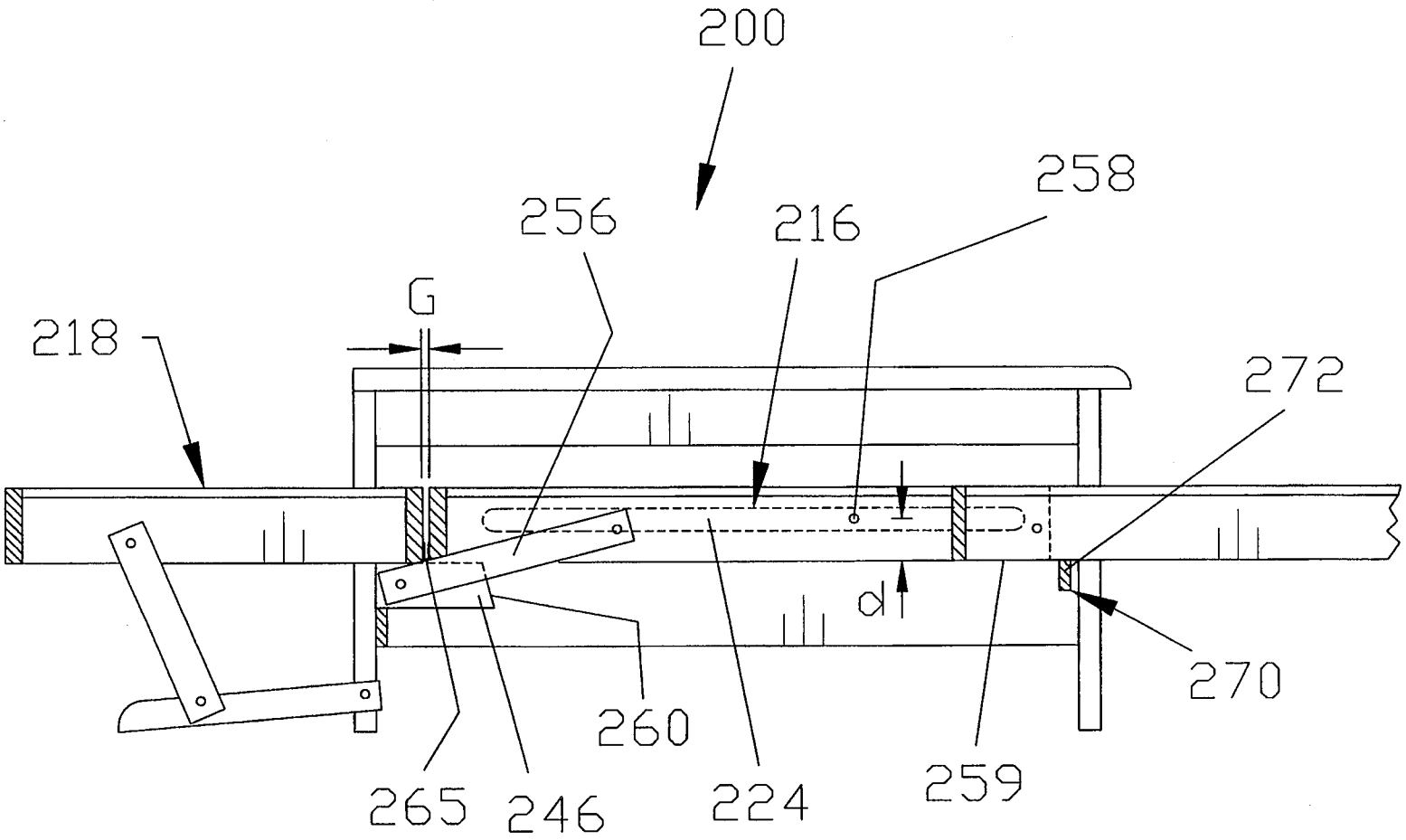
FIG. 7 is a sectional side view of the same embodiment as shown in FIG. 6, however, the frame is open forming a platform to support an extended futon for use as a bed. The slats shown in FIG. 6 are not illustrated.

The backstops 246 have upper support surfaces 256 which are substantially parallel to the guide slots 224 in the base ends 220 and 222. These upper support surfaces 256 of the backstops 246 provide support to the back 216 when the back 216 is in a horizontal position as is illustrated in FIG. 7.

Figure 8:
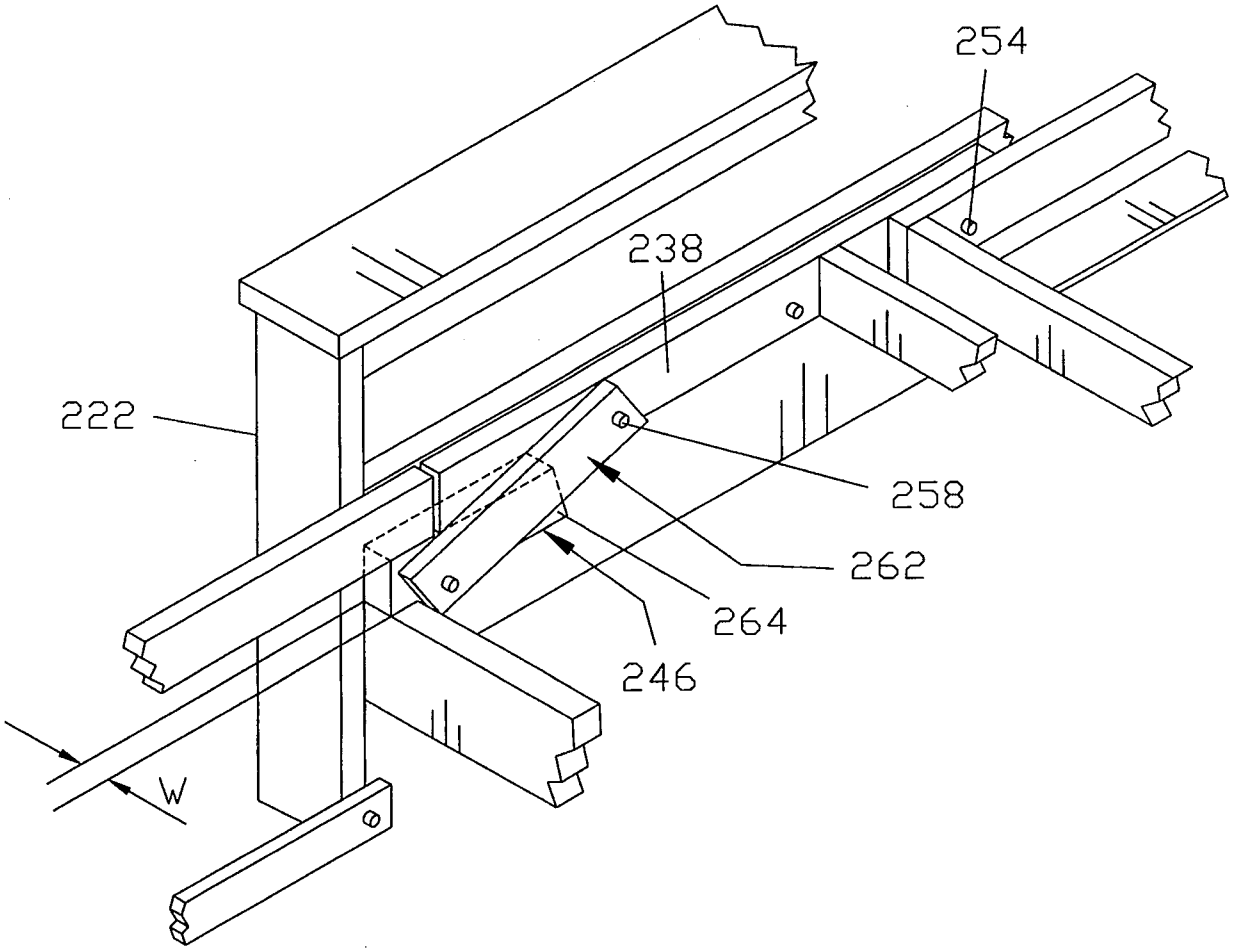
FIG. 8 is an isometric view of the section of the backstop region of FIG. 7 showing the upper support surface of the backstop supporting the back when the frame is opened to form a bed.

In order for the upper support surfaces 256 to fully support the back 216, the upper support surfaces 256 should be mounted parallel to the slots 224 in which the guide post 258, attached to the back 216, rides. Furthermore, as shown in FIG. 7, the distance d between the center of the guide post 258 and the lower surface 259 of the back 216 should be equal to the offset of the upper support surface 256 from the slots 224 as is denoted in FIG. 7. The backstops 246 also have upright support surfaces 260. FIG. 6 best illustrates one of upright support surfaces 260 providing support to the back 216 when it is in an upright position. It is further preferred, as is shown in FIG. 8, that backstops 246 have a width W which is greater or equal to the width w of the back side rails 238. Having the backstops 246 and back side rails 238 so proportioned provides full contact between the back side rails 238 and maximizes support of the back 216 by the backstops 246.

Referring again to FIGS. 5 and 6, rear linkages 262 pivotably attach to the back 216 and either directly or indirectly attach to the first base end 220 and the second base end 222. The rear linkages 262, in combination with the guide post 258 and the guide slot 224, assist in directing the movement of the back 216 from the upright position shown in FIG. 6 to the horizontal position shown in FIG. 7. As best shown in FIG. 8, the backstops 246 have backstop free surfaces 264 which are parallel to the base ends 220 and 222. The backstop free surfaces 264 serve as the mounting surfaces for the rear linkages 262 and maintain the rear linkages 262 in parallel relationship to the back side rails 238. This is a preferred coupling of the rear linkages 262 to the backstops 246 and the back side rails 238 since it maintains the parallel relationship without requiring additional hardware.

An angle $\alpha$ denoted in FIG. 6 of between about 75° and 85° should preferably be maintained between the upper support surfaces 256 and the rear linkage 262 when the back 216 is in the upright position. The upper limit of $\alpha$ is set so as to avoid the back being forced to an angle greater than 90°, which will cause the frame 200 to lock in the upright position. Maintaining the angle $\alpha$ above the lower limit is preferred since it will limit depth D of the base 212.

Hinges 265 for the embodiment of FIGS. 5 through 9, best illustrated in FIG. 6, pivotably attach the back 216 to the rear deck panel 218. The hinges 265 are preferably surface mounted hinges and are mounted on the back top edge 234 and the rear deck panel back edge 240. Having the hinges 265 so mounted assures that there will be a gap G between the rear deck panel back edge 240 and the back top edge 234, when the frame 200 is opened to form a bed frame as is illustrated in FIG. 5. The gap G provided should preferably be at least about $\frac{1}{4}''$. The gap G will allow the adjustment to compensate for the unevenness of the surface on which the frame 200 rests. Hinges such as described above are best illustrated in FIG. 3 and serve the same function for the embodiment of FIGS. 3 and 4.

FIG. 9 shows an isometric view of the embodiment illustrated in FIGS. 5 through 8. As is discussed above, the rear deck panel 218 is bounded by the rear deck panel back edge 240 which is spaced apart and substantially parallel to the rear deck panel free end 242 and by a pair of spaced apart rear deck panel side rails 244. Slats 232 are provided for additional support of a futon.

It is preferred that the rear deck panel back edge 240 lie within the confines of the base 212 when the back 216 is lowered. Having the rear deck panel back edge 240 so positioned further enhances the rigidity of the "A" frame 200 chair by allowing the back 216 as well as the rear deck panel 218 to rest on the backstops 246. The support of the back 216 and the rear deck panel 218 by the backstops 246 when the back is lowered is best illustrated in FIGS. 7 and 8.

It is further preferred that a front cross member 270 be provided for additional support of the seat 214. FIG. 7 illustrates the relative position of the front cross member 270 with respect to the back stops 246. The cross member 270 should be positioned such that the front cross member 270 has the upper edge 272 which is co-planer with the upper support surface 256 of the backstops 246. (See FIG. 7.)

FIG. 9 also illustrates the use of seat support legs 274 providing additional support to seat 214 when is opened to form a bed frame.

When the rear deck supports 248, shown in FIG. 5, are employed, which have two segments, the support segments 250 and the base support segments 252, in order to facilitate the cooperative movement of the rear deck panel 218, the back 216, and the seat 214, it is preferred that a deck stop be provided to assure that the rear deck panel 218 cannot swing past the deck support segments 250. For the embodiment illustrated in FIGS. 5 through 9, the deck stop is provided by a free end 242 of the rear deck panel 218. This feature is best illustrated in FIG. 6. Each of the deck support segments 250 are mounted to and between the rear deck panel side rails 244. With this configuration, the deck support segments 250 will be mounted internally to the periphery of the rear deck panel 218 defined by the rear deck panel back edge 240, the rear deck panel free end 242, and the pair of rear deck panel side rails 244. Being so configured assures that, as the rear deck panel 218 is folded and the deck support segments 250 pivot towards the rear deck panel 218, they will be stopped from pivoting beyond the rear deck panel 218 by the free end 242.

While the invention has been described in terms of preferred embodiment, it should be appreciated that variations of the present invention are possible in light of the above teaching and that variations can be made without departing from the spirit of the invention.

What I claim is:

1. An improved frame for a futon having a base with a first base end having a guide slot and a second base end having a guide slot, a seat, and a back having guide posts which engage the first guide slot and the second guide slot, the back being pivotably attached to the seat, the back moving from an upright position to a horizontal position comprising:

a first backstop attached to the first base end;

a second backstop attached to the second base end;

said first backstop and said second backstop having, upper support surfaces which are substantially parallel to the guide slots, said upper support surfaces engaging the back when in its horizontal position, and upright support surfaces which engage the back when in its upright position; and a pair of rear linkages pivotably mounted to the back and pivotably mounted with respect to the first base end and the second base end.

2. The improved frame of claim 1 wherein said first backstop and said second backstop have backstop free surfaces which are substantially parallel to the first base end and to the second base end and said pair of rear linkages are pivotably mounted to said free surfaces, of said first backstop and said second backstop.

3. The improved frame of claim 2 wherein said first backstop and said second backstop have a width W;

further wherein the back has side-rails, said back side-rails having a width w such that $W \geqq w$.

4. The improved frame of claim 2 wherein the base of the frame has a front cross member having an upper front cross member edge which is co-planer with said upper support surfaces of said first backstop and said second backstop.

5. The improved frame of claim 2 wherein said pair of rear linkages form an angle of between about 75° and 85° with respect to said first backstop and said second backstop when the back is in an upright position.

6. An improved tri-fold frame for a futon, the frame having a base with base ends with guide slots therein, a seat, a back, and a rear deck panel pivotably attached to the back allowing the frame to serve as a sofa/chair and a bed frame, wherein the seat, back and rear deck panel are co-planer, the improvement comprising:

a pair of rear deck supports pivotably attached to the rear deck panel and to the base, wherein each of said rear deck supports further comprises:

a deck segment support pivotably attached to the rear deck panel; and a base segment support pivotably attached to the base deck and pivotably attached to said deck segment support.

7. The improved tri-fold frame of claim 6 further comprising a deck-stop thereby limiting the motion of the rear deck.

8. The improved tri-fold frame of claim 7 wherein the rear deck panel further comprises:

a rear deck panel back edge;

a free edge;

a pair of spaced apart side rails; and further wherein said rear deck segment supports are mounted to said spaced apart side rails and lie therebetween thereby allowing said free edge to serve as said deck stop.

9. The improved tri-fold frame of claim 8 wherein the back has a back top edge and further comprising hinges attaching to said back deck edge and to said back top edge.

10. The improved tri-fold frame of claim 9 wherein said hinges are mounted to provide a gap between said rear deck panel back edge and said back top edge when the seat, the back, and the rear deck panel are co-planer.

11. The improved tri-fold frame of claim 10 further comprising:

backstops attached to the base ends;

each said backstop having, upper support surfaces which are substantially parallel to the guide slots, said upper support surfaces engaging the back when the frame serves as a bed, and upright support surfaces which engage the back when the frame serves as a sofa/chair.

12. An improved tri-fold frame for a futon, the frame having a base with base ends with guide slots therein, a seat, a back, and a rear deck panel pivotably attached to the back allowing the frame to serve as a sofa/chair and a bed frame, the improvement comprising:

a pair of rear deck supports pivotably attached to the rear deck panel and to the base, and at least one rear deck panel leg pivotably attached to the rear deck panel.

13. The improved tri-fold frame of claim 12 wherein the back has a back top edge and the rear deck panel further comprises:

a rear deck panel back edge;

a free edge;

a pair of spaced apart side rails; and hinges attaching to said rear deck panel back edge and to said back top edge.

14. The improved tri-fold frame of claim 13 wherein said hinges are mounted to provide a gap between said rear deck panel back edge and said back top edge when the seat, the back and the rear deck panel are co-planer.

15. The improved tri-fold frame of claim 14 further comprising:

backstops attached to the base ends;

each said backstop having, upper support surfaces which are substantially parallel to the guide slots, said upper support surfaces engaging the back when the frame serves as a bed, and upright support surfaces which engage the back when the frame serves as a sofa/chair.

16. An improved tri-fold frame for a futon, the frame having a base with base ends with guide slots therein, a seat, pivotably attached to a back and pivotably mounted thereto, and a rear deck panel pivotably attached to the back allowing the frame to serve as a sofa/chair and a bed frame, in which case the seat, back and rear deck panel are co-planer, the improvement comprising:

a pair of rear deck supports pivotably attached to the rear deck panel and to the base; and at least one rear deck panel leg pivotably attached to the rear deck panel.

17. The improved tri-fold frame of claim 16 further comprising a deck-stop thereby limiting the motion of the rear deck.

18. The improved tri-fold frame of claim 17 wherein the rear deck panel further comprises:

a rear deck back panel edge;

a free edge;

a pair of spaced apart side rails; and further wherein each of said pair of said deck segment supports are mounted to said spaced apart side rails and lie therebetween thereby allowing said free edge to serve as said deck stop.

19. The improved tri-fold frame of claim 18 wherein the back has a back top edge and further comprising hinges attaching to said rear deck back panel edge and to said back top edge.

20. The improved tri-fold frame of claim 19 wherein said hinges are mounted to provide a gap between said rear deck panel back edge and said back top edge when the seat, the back, and the rear deck panel are co-planer.

21. The improved tri-fold frame of claim 20 further comprising:

backstops attached to the base ends;

each said backstop having, upper support surfaces which are substantially parallel to the guide slots, said upper support surfaces engaging the back when the frame serves as a bed, and upright support surfaces which engage the back when the frame serves as a sofa/chair.

22. The improved tri-fold frame of claim 17 wherein said hinges are mounted to provide a gap between said rear deck panel back edge and said back top edge when the seat, the back and the rear deck panel are co-planer.

23. The improved tri-fold frame of claim 22 further comprising:

backstops attached to the base ends;

each said backstop having, upper support surfaces which are substantially parallel to the guide slots, said upper support surfaces engaging the back when the frame serves as a bed, and upright support surfaces which engage the back when the frame serves as a sofa/chair.

24. The improved tri-fold frame of claim 16 wherein the back deck has a back top edge and the rear deck panel further comprises:

a rear deck panel back edge;

a free edge;

a pair of spaced apart side rails; and hinges attaching to said rear deck back panel edge and to said back top edge.

25. An improved tri-fold frame for a futon, the frame having a base with base ends with guide slots therein, a seat, pivotably attached to a back and pivotably mounted thereto, and a rear deck panel pivotably attached to the back allowing the frame to serve as a sofa/chair and a bed frame, in which case the seat, back and rear deck panel are co-planer, the improvement comprising:

a pair of rear deck supports pivotably attached to the rear deck panel and to the base said pair of rear deck supports having:

a deck segment support pivotably attached to the rear deck panel; and a base segment support pivotably attached to the rear deck panel and pivotably attached to said deck segment support.

* * * * *